US007661357B2

(12) United States Patent
Ebisawa et al.

(10) Patent No.: US 7,661,357 B2
(45) Date of Patent: Feb. 16, 2010

(54) STENCIL PRINTING MACHINE WITH A PLURALITY OF DRUM UNITS AND METHOD OF CONTROLLING THE SAME

(75) Inventors: Takashi Ebisawa, Ibaraki-ken (JP); Mitsuaki Ishitoya, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 12/216,281

(22) Filed: Jul. 2, 2008

(65) Prior Publication Data

US 2008/0271617 A1 Nov. 6, 2008

Related U.S. Application Data

(62) Division of application No. 11/110,789, filed on Apr. 21, 2005, now Pat. No. 7,409,907.

(30) Foreign Application Priority Data

Apr. 22, 2004 (JP) ..... 2004-126474

(51) Int. Cl.
*B41C 1/14* (2006.01)

(52) U.S. Cl. ..... 101/128.4; 101/116; 101/129; 358/2.1; 358/3.22; 358/3.29

(58) Field of Classification Search ..... 101/114, 101/115, 116, 128.21, 128.4, 129; 358/1.6, 358/1.9, 2.1, 3.22, 3.23, 3.29
See application file for complete search history.

(56) References Cited

U.S. PATENT DOCUMENTS

| | | | | |
|---|---|---|---|---|
| 5,526,032 | A | 6/1996 | Nakamura | 347/211 |
| 5,765,477 | A | 6/1998 | Yoshida | 101/128.4 |
| 6,281,919 | B1 | 8/2001 | Okada | 347/172 |
| 2007/0188779 | A1 | 8/2007 | Nagao et al. | 358/1.9 |

FOREIGN PATENT DOCUMENTS

| | | |
|---|---|---|
| JP | 63-108477 | 5/1988 |
| JP | 63-224987 | 9/1988 |
| JP | 04-299471 | 10/1992 |
| JP | 05-254237 | 10/1993 |

*Primary Examiner*—Ren Yan
(74) *Attorney, Agent, or Firm*—The Nath Law Group; Jerald L. Meyer; Robert T. Burns

(57) ABSTRACT

A controller reads out image data of an area frame that a user has drawn on an original and accurately extracts the area frame by removing noise from the read-out image data to divide image data of an area outside the area frame and image data of an area inside the area frame into separate stencils, according to a separation program. It is therefore possible to execute a separation process desired by the user without increasing costs and man-hours and with easy operations not making the user feel troublesome.

3 Claims, 14 Drawing Sheets

STENCIL PRINTING MACHINE WITH A PLURALITY OF DRUM UNITS AND METHOD OF CONTROLLING THE SAME

BACKGROUND OF THE INVENTION

The present invention relates to a stencil printing machine with a plurality of drum units and a method of controlling the same.

A stencil printing machine with a plurality of drum units has been hitherto known. With such a stencil printing machine, as disclosed in the Japanese Patent No. 2911891, an area specified by a user and the other area can be separately printed by perforating separate stencil sheets by heat according to an image of the specified area and an image of the other area and then loading the perforated stencil sheets on respective drum units.

The style of separation that the user desires varies on originals. However, according to the configuration of the conventional stencil printing, the separation area is specified by causing the printing machine to scan a sheet in which the separation area is specified. Accordingly, the number of man hours for the separation process increases, and furthermore, when the sheet is contaminated, noise which is difficult to remove is added to an original image in some cases. Moreover, black letters and colored letters within the original cannot be separated unless the user specifies an area.

For two-color separation, it is possible to add various types of hardware elements such as a digitizer, a color scanner to recognize colors of originals, and an automatic two-color separation function to the machine. However, addition of the hardware elements to the machine increases costs of the stencil printing machine. Moreover, users tend to avoid a separation operation using a digitizer and a separation operation requiring specifying each color because the methods thereof are difficult to understand and the operations thereof are complicated.

The present invention was made to solve the aforementioned problem and an object of the present invention is to provide a stencil printing machine capable of executing a separation process that a user desires with an easy operation not making the user feel troublesome and the method of controlling the same.

Another object of the present invention is to provide a stencil printing machine capable of selectively executing various types of separation processes that the user desires and the method of controlling the same.

SUMMARY OF THE INVENTION

For solving the aforementioned problem, a stencil printing machine as a first aspect of the present invention is a stencil printing machine including a plurality of drum units and includes: an original scanning unit reading in image data of an original as original image data, the original on which an area frame for specifying a separation area is drawn; and a controller including a unit for reading out image data with a density range of the area frame from the original image data as area frame density extraction data and a unit for removing noise which is data of an image other than the area frame from the area frame density extraction data. The controller controls the stencil printing machine to divide image data inside the area frame and image data outside the area frame into separate stencils using the area frame density extraction data with the noise removed and the original image data.

A method of controlling a stencil printing machine as the first aspect of the present invention is a method of controlling a stencil printing machine including a plurality of drum units and includes the steps of: reading in image data of an original as original image data, the original on which an area frame for specifying a separation area is drawn; reading out image data with a density range of the area frame from the original image data as area frame density extraction data; removing noise which is data of an image other than the area frame from the area frame density extraction data; and controlling the stencil printing machine to separate image data inside the area frame and image data outside the area frame using the area frame density extraction data with the noise removed and the original image data.

According to the stencil printing machine as the first aspect of the present invention and the method of controlling the same, the image data of the area frame that the user has drawn on the original is read out, and the area frame is accurately extracted by removing noise from the read-out image data to divide image data of an area outside the area frame and image data of an area inside the area frame into separate stencils. This allows the separation process for the images inside and outside the area frame without increasing costs and man-hours and with easy operations not making the user feel troublesome.

For solving the aforementioned problem, a stencil printing machine as a second aspect of the present invention is a stencil printing machine including a plurality of drum units and includes: an original scanning unit reading in image data of an original as original image data, the original including a black letter and an image with a specific density range; and a controller including a unit for reading out image data of the black letter and image data of the image with the specific density range from the original image data as black letter extraction data and specific density range extraction data, respectively and a unit for removing noise from the specific density range extraction data. The controller controls the stencil printing machine to divide an image of the black letter and the image with the specific density range into separate stencils using the specific density range extraction data with the noise removed and the black letter extraction data.

A method of controlling a stencil printing machine as a second aspect of the present invention is a method of controlling a stencil printing machine including a plurality of drum units and includes the steps of: reading in image data of an original as original image data, the original including a black letter and an image with a specific density range; reading out image data of the black letter and image data with a specific density range from the original image data as black letter extraction data and specific density range extraction data, respectively; removing noise from the specific density range extraction data; and controlling the stencil printing machine to separate an image of the black letter and the image with the specific density range using the specific density range extraction data with the noise removed and the black letter extraction data.

According to the stencil printing machine as the second aspect of the present invention and the method of controlling the same, the image data with a specific density range is read out, and the image data with the specific density range is accurately extracted by removing noise from the read-out image data with the specific density range to divide the image data with the specific density range and the image data of the black letter into separate stencils. Accordingly, the user does not need to specify individual areas, and it is possible to perform the separation process for the black letter and the image with the specific density range within the original without increasing costs and with easy operations which does not feel troublesome.

Furthermore, for solving the aforementioned problem, a stencil printing machine as a third aspect of the present invention is a stencil printing machine including a plurality of drum units and includes: an original scanning unit reading in image data of an original; an operation unit for a user to select a desired separation printing mode among a plurality of printing modes; and a controller controlling the stencil printing machine to divide image data read in by the original scanning unit into separate stencils according to the separation printing mode selected by means of the operation unit. The plurality of separation printing modes include at least first and second separation printing modes. In the first separation printing mode, the original scanning unit reads in the image data of an original as original image data, the original on which an area frame specifying a separation area is drawn. The controller reads out image data with a density range of the area frame from the original image data as area frame density extraction data; removes noise which is data of an image other than the area frame from the area frame density extraction data; and controls the stencil printing machine to divide image data inside the area frame and image data outside the area frame into separate stencils using the area frame density extraction data with the noise removed and the original image data. In the second separation printing mode, the original scanning unit reads in image data of an original as original image data, the original including a black letter and an image with a specific density range. The controller reads out image data of the black letter and image data of the image with the specific density range from the original image data as black letter extraction data and specific density range extraction data, respectively; removes noise from the specific density range extraction data; and controls the stencil printing machine to divide an image of the black letter and the image with the specific density range into separate stencils using the specific density range extraction data with the noise removed and the black letter extraction data.

A method of controlling a stencil printing machine as a third aspect of the present invention is a method of controlling a stencil printing machine including a plurality of drum units and includes the steps of: reading in image data of an original; and controlling the stencil printing machine to divide the read-in image data into separate stencils according to a separation printing mode selected by a user from a plurality of separation printing modes. The plurality of separation printing modes include at least: a first separation printing mode of reading in image data of an original as original image data, the original on which an area frame for specifying a separation area is drawn; reading out image data with a density range of the area frame from the original image data as area frame density extraction data; removing noise which is data of an image other than area frame from the area frame density extraction data; and controlling the stencil printing machine to divide image data inside the area frame and image data outside the area frame into separate stencils using the area frame density extraction data with noise removed and the original image data; and a second separation printing mode of reading in image data of an original as original image data, the original including a black letter and an image with a specific density range; reading out image data of the black letter and image data of the image with the specific density range from the original image data as black letter extraction data and specific density range extraction data, respectively; removing noise from the specific density range extraction data; and controlling the stencil printing machine to divide an image of the black letter and the image with the specific density range into separate stencils using the specific density range extraction data with the noise removed and the black letter extraction data.

In the stencil printing machine as the third aspect of the present invention and the method of controlling the same, the process to divide the image data of the area outside the area frame and the image data of the area inside the area frame into separate stencils or the process to divide the black letter and the image with a specific density range within the original into separate stencils is performed according to the separation printing mode selected by the user. Accordingly, it is possible to provide the stencil printing machine and the method of controlling the same capable of selecting and executing various types of separation processes desired by the user.

DETAILED DESCRIPTION OF THE PREFERRED EMBODIMENTS

Hereinafter, a detailed description is given of configurations and actions of stencil printing machines as embodiments of the present invention with reference to the drawings.

First, the configuration of the stencil printing machine as an embodiment of the present invention is described with reference to FIG. 1.

Figure 1:
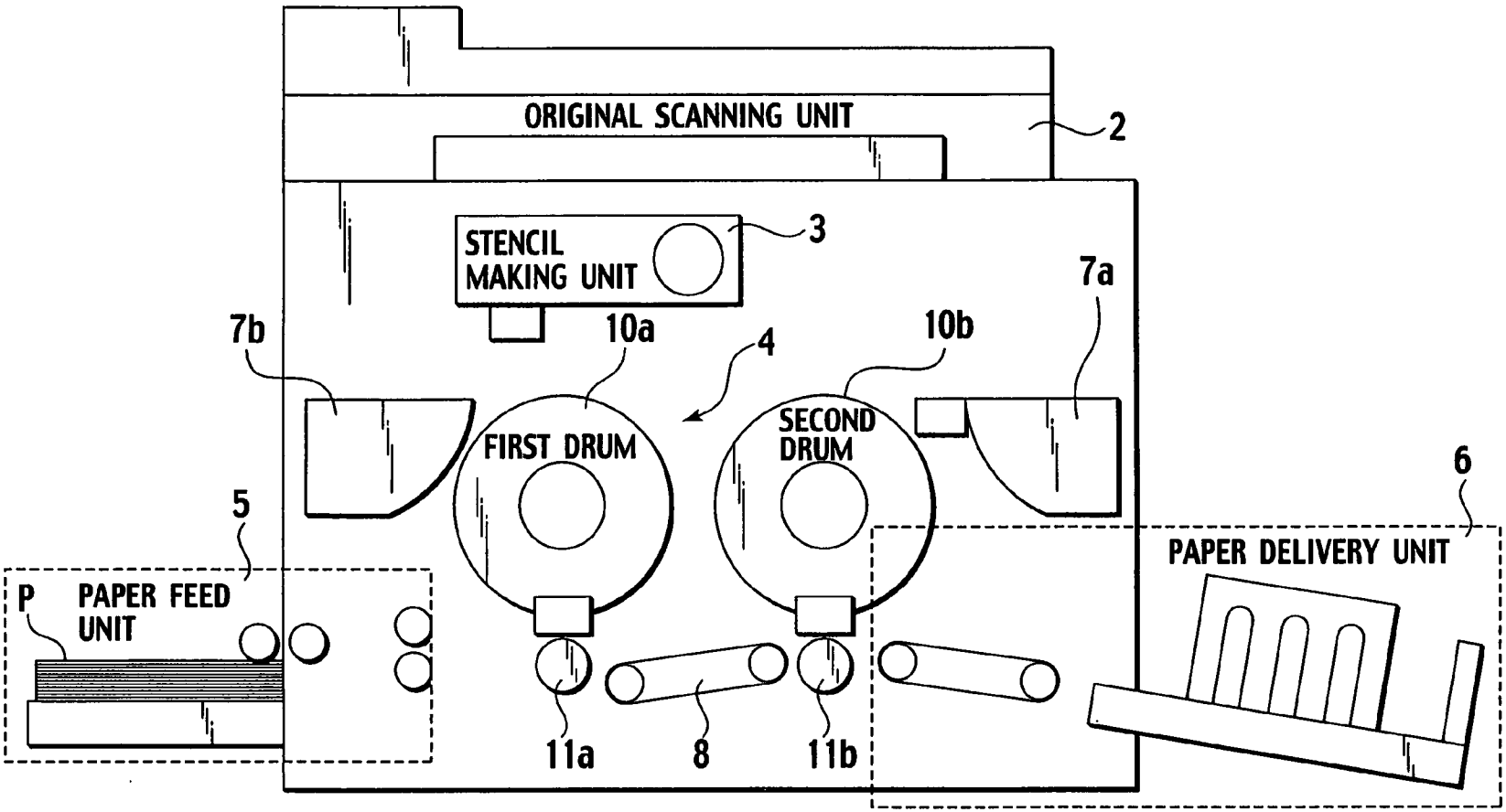
FIG. 1 is a schematic view showing a configuration of a stencil printing machine as an embodiment of the present invention.

FIG. 1 is a schematic view showing the configuration of the stencil printing machine as the embodiment of the present invention.

As shown in FIG. 1, a stencil printing machine 1 as the embodiment of the present invention includes an original scanning unit 2, a stencil making unit 3, a printing unit 4, a paper feed unit 5, a paper delivery unit 6, first and second stencil disposal units 7*a* and 7*b*, and an intermediate conveyor unit 8 as main components. The stencil printing machine 1 is configured to perform stencil printing for image data of an originals canned by the original scanning unit 2. Hereinafter, the configuration of each component is described in detail.

The original scanning unit 2 is provided in the upper part of the machine body and composed of a monochrome scanner. The original scanning unit 2 reads in image data of an original to be printed and inputs the read-in image data into the controller 9 (see FIG. 2) within the stencil printing machine 1.

The stencil making unit 3 includes a stencil making unit provided for the machine body so as to be horizontally movable. This stencil making unit is moved by stencil making unit moving means between a first stencil sheet feed position and a second stencil sheet feed position at which stencil sheets are fed to first and second drum units 10*a* and 10*b*, respectively. The stencil making unit moving means includes a stencil making unit moving motor fixed to the stencil making unit, a worm gear fixed to a rotating shaft of the stencil making unit moving motor, a worm wheel engaged with the worm gear, a pinion gear coaxially fixed to the worm wheel, and a rack fixed to the machine body.

The above stencil making unit includes a stencil sheet accommodating unit, a plurality of conveyor rollers, a thermal print head, a platen roller, a stencil sheet transfer roller, a guide plate, and a stencil sheet cutter. The stencil sheet accommodating unit accommodates a long stencil sheet in a rolled shape. The conveyor rollers guide the leading edge of the stencil sheet accommodated in the stencil sheet accommodating unit down the conveying stream. The thermal print head is placed on the downstream side of the conveyor rollers. The platen roller is placed to face the thermal head and rotated by a driving force of a write pulse motor. The stencil sheet transfer roller is placed on the downstream side of the platen roller and thermal print head in the conveying direction of the stencil sheet and rotated by a driving force of the write pulse motor. The guide plate is pressed by the stencil sheet transfer roller. The stencil sheet cutter is placed between the stencil sheet transfer roller and guide plate and the platen roller and thermal head.

The stencil making unit 3 having such a configuration perforates the stencil sheet by heat according to image data of the original under controls by the controller 9 and supplies the perforated stencil sheet (hereinafter, referred to as a master) to the printing unit 4.

The above printing unit 4 is connected to a main motor through a belt and includes the first and second drum 10*a* and 10*b* rotationally driven by the main motor. The outer peripheral surfaces of the first and second drums 10*a* and 10*b* are formed of a material with excellent ink transparency and high rigidity. Masters made in the stencil making unit 3 are wound around the outer peripheral surfaces of the first and second drums 10*a* and 10*b* with the leading edge thereof held by clamp means. On the rotating shafts of the first and second drums 10*a* and 10*b*, drum encoders which generate pulse signals (drum pulses) according to rotation angles of the first and second drums 10*a* and 10*b*, respectively, are provided.

In the vicinities of the outer peripheral surfaces of the first and second drums 10*a* and 10*b*, position detection sensors for detecting positions (reference positions) at which the masters are clamped by the clamp means are provided. The rotation angles of the first and second drums 10*a* and 10*b* are constantly detected based on signals from the drum encoders and position detection sensors. The circumferential velocities of the first and second drums 10*a* and 10*b* are controlled to be substantially constant in such a manner that a motor rotation controller controls rotation of the main motor, which rotationally drives the first and second drums 10*a* and 10*b*, based on the detected rotation angles by means of the PWM control.

Inside each of the first and second drums 10*a* and 10*b*, an ink container, an ink supply roller, a doctor roller, and an ink supply pipe are provided. The ink supply roller is in contact with the inner peripheral surface of a peripheral wall. The doctor roller supplies a predetermined amount of ink to the ink supply roller. The ink supply pipe is provided between the doctor roller and the ink supply roller and supplies the predetermined amount of ink sucked from the ink container through a pump. Under the first and second drums 10*a* and 10*b*, pressure rollers 11*a* and 11*b* are rotatably provided in parallel to the first and second drums 10*a* and 10*b*, respectively.

The pressure rollers 11*a* and 11*b* are guided by a press cam driven by the main motor and operated so as to move close to and away from the first and second drums 10*a* and 10*b* in synchronization with rotation of the first and second drums 10*a* and 10*b*, respectively. Each of the pressure rollers 11*a* and 11*b* is provided with a print pressure variable motor. The print pressures against the first and second drums 10*a* and 10*b* can be independently adjusted by driving the pressure rollers 11*a* and 11*b*, respectively.

The printing unit 4 having such a configuration prints an image on print sheets in the following manner. First, print sheets P fed by a timing roller of the paper feed unit 5 are sandwiched between the first drum 10*a* and the pressure roller 11*a*, and ink is transferred to the print sheets P through the master wound around the outer peripheral surface of the first drum 10*a* while the print sheets P are conveyed along with rotation of the first drum 10*a* and pressure roller 11*a*. Next, the printing sheets P fed through the intermediate conveyor unit 8 are sandwiched between the second drum 10*b* and the pressure roller 11*b*, and ink is transferred to the print sheets P through the master wound around the outer peripheral surface of the second drum 10*b* while the print sheets P are conveyed along with rotation of the second drum 10*b* and pressure roller 11*b*.

The above paper feed unit 5 has a structure to take out the print sheets P placed on a paper feed tray one by one with a paper feed roller and a paper handling roller and then feed the taken out print sheets P between the first drum 10*a* and the pressure roller 11*a* in synchronization of rotation of the first drum 10*a* by a timing roller.

The aforementioned paper delivery unit 6 is configured to peel the print sheets P having the image data printed thereon off the second drum 10*b* with a sheet separator claw and convey the print sheets P peeled off the second drum 10*b* with conveying means to discharge the same on a paper receiving tray. The conveying means includes a pair of pulleys and an endless conveyor belt laid therebetween. The endless conveyor belt is provided with a number of air passage holes. A suction fan motor provided under the endless conveyor belt sucks air above, and the print sheets P are thereby held on the endless conveyor belt and conveyed.

The aforementioned first and second stencil disposal units 7*a* and 7*b* are provided corresponding to the first and second drums 10*a* and 10*b*, respectively. The first and second stencil disposal units 7*a* and 7*b* are configured to peel the used masters off the outer peripheral surfaces of the first and second drums 10*a* and 10*b* with stencil removal hooks and convey the used masters by means of a pair of upper and lower stencil disposal rollers to accommodate the used master in a stencil disposal box. The upper stencil disposal roller among the pair of upper and lower stencil disposal rollers is connected to a stencil disposal motor through a belt and rotationally driven by this stencil disposal motor. The lower stencil disposal roller among the pair of upper and lower stencil disposal rollers is connected to the upper stencil disposal roller through gears and rotationally driven together with the upper stencil transport roller.

In the vicinities of the stencil disposal rollers, guide rollers are provided. Between the stencil disposal rollers and the respective guide rollers, conveyor guide belts are laid. The pair of upper and lower stencil disposal rollers is rotationally driven by the stencil disposal motor, and the conveyor guide belts are thereby driven. The used masters peeled off the outer peripheral surfaces of the first and second drums 10*a* and 10*b* by the stencil removal hooks are guided by the conveyor guide belts to the stencil disposal boxes of the first and second stencil disposal units 7*a* and 7*b*, respectively.

The intermediate conveyor unit 8 is configured to peel the print sheets P with an image printed thereon off the first drum 10*a* with the sheet separator hook and feed the print sheets P peeled off the first drum 10*a* between the second drum 10*b* and the press roller 11*b* in synchronization with rotation of the second drum 10*b* by conveying means. Herein, the conveying means includes a pair of pulleys and an endless conveyor belt laid there between. The endless convey or belt is provided with a number of air passage holes, and a suction fan motor provided under the endless conveyor belt sucks air above, and the print sheets P are thereby held on the endless conveyor belt and conveyed.

Figure 2:
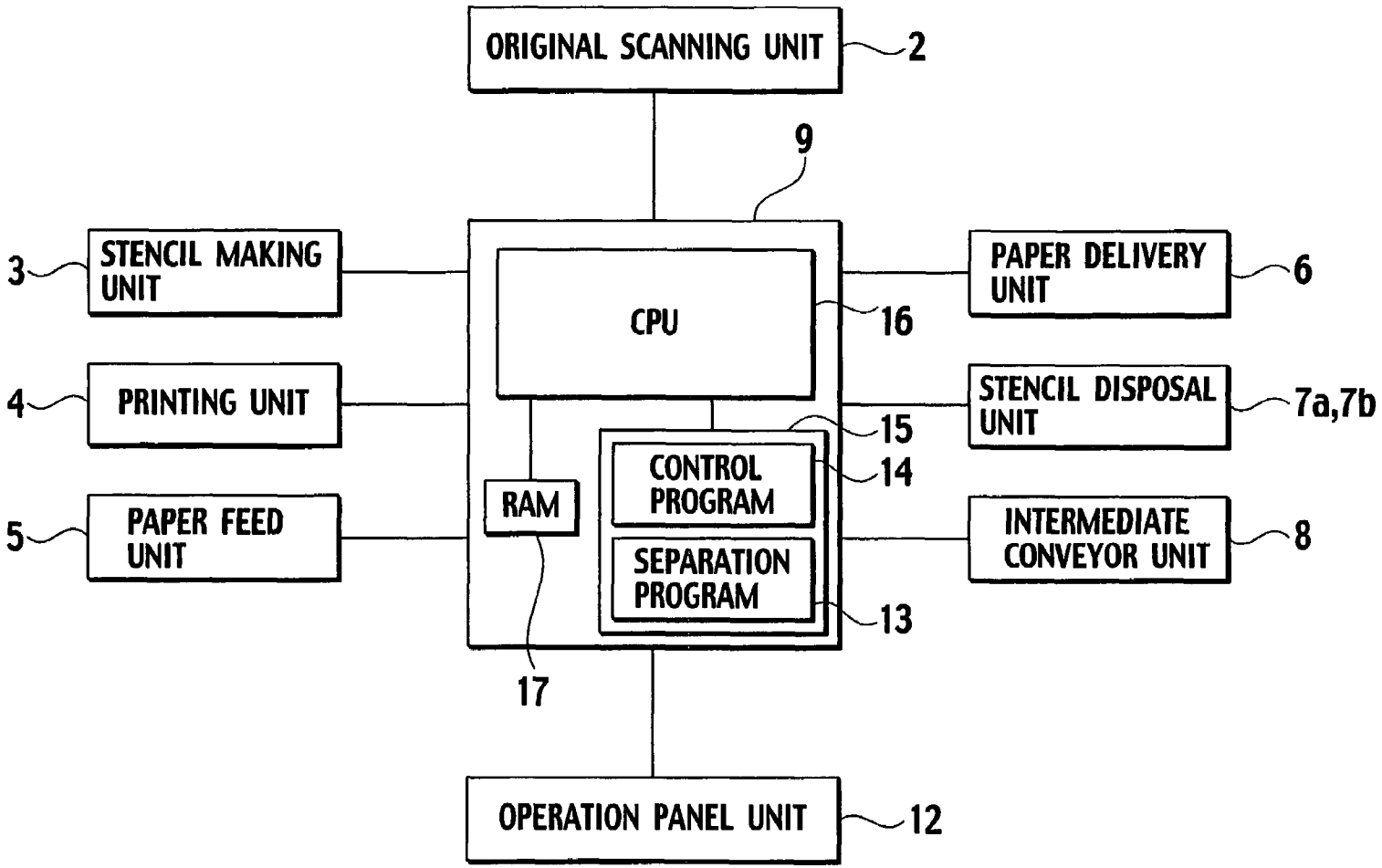
FIG. 2 is a block diagram showing a configuration of a controller of the stencil printing machine shown in FIG. 1.

Next, a description is given of a configuration of a controller of the stencil printing machine 1 with reference to FIG. 2.

FIG. 2 is a block diagram showing the configuration of the controller of the stencil printing machine shown in FIG. 1.

In the aforementioned stencil printing machine 1, as shown in FIG. 2, the controller 9 controls each component of the stencil printing machine 1 according to information inputted by a user through an operation panel unit 12 to execute stencil printing. The controller 9 includes a ROM (read only memory) 15 storing a separation program 13 and a control program 14 to execute the later-described separation process, a CPU 16 controlling each component of the stencil printing machine 1 according to the computer programs stored in the ROM 15, and a RAM 17 functioning as a working area for the CPU 16 in various controls.

In this embodiment, the separation program 13 and the control program 14 are described as separate computer programs but can be composed of a single computer program. The operation panel unit 12 includes a start key for starting a printing action, a stop key for stopping the printing action, a numeric keypad for entering the number of prints, a number-of-print display unit composed of a seven segment LED or the like, and a liquid crystal touch panel unit for setting up various functions. The number-of-print display unit displays the number of remaining sheets to be printed based on the number of prints entered by the numeric keypad and information (print end signal) indicating that one sheet has been printed after the printing action starts.

The stencil printing machine 1 having such a configuration operates as shown in the following according to the separation program 13 and thereby executes the separation process that the user desires with easy operations that the user does not feel troublesome without increasing costs and man-hours. Hereinafter, a detailed description is given of an action of the stencil printing machine 1 executing the separation process as the first and second embodiments of the present invention with reference to the drawings.

First, the action of the stencil printing machine 1 executing the separation process as the first embodiment of the present invention is described with reference to a flowchart shown in FIG. 3. The separation process as the first embodiment is a process that a user draws an area frame on an original using a marker with a predetermined width of, for example, 0.5 mm or more and less than 3 mm and a predetermined density of, for example, 100 to 230 (tone) and that the stencil printing machine 1 divides images inside and outside the area frame into separate stencils for the first and second drums 10*a* and 10*b*.

Figure 3:
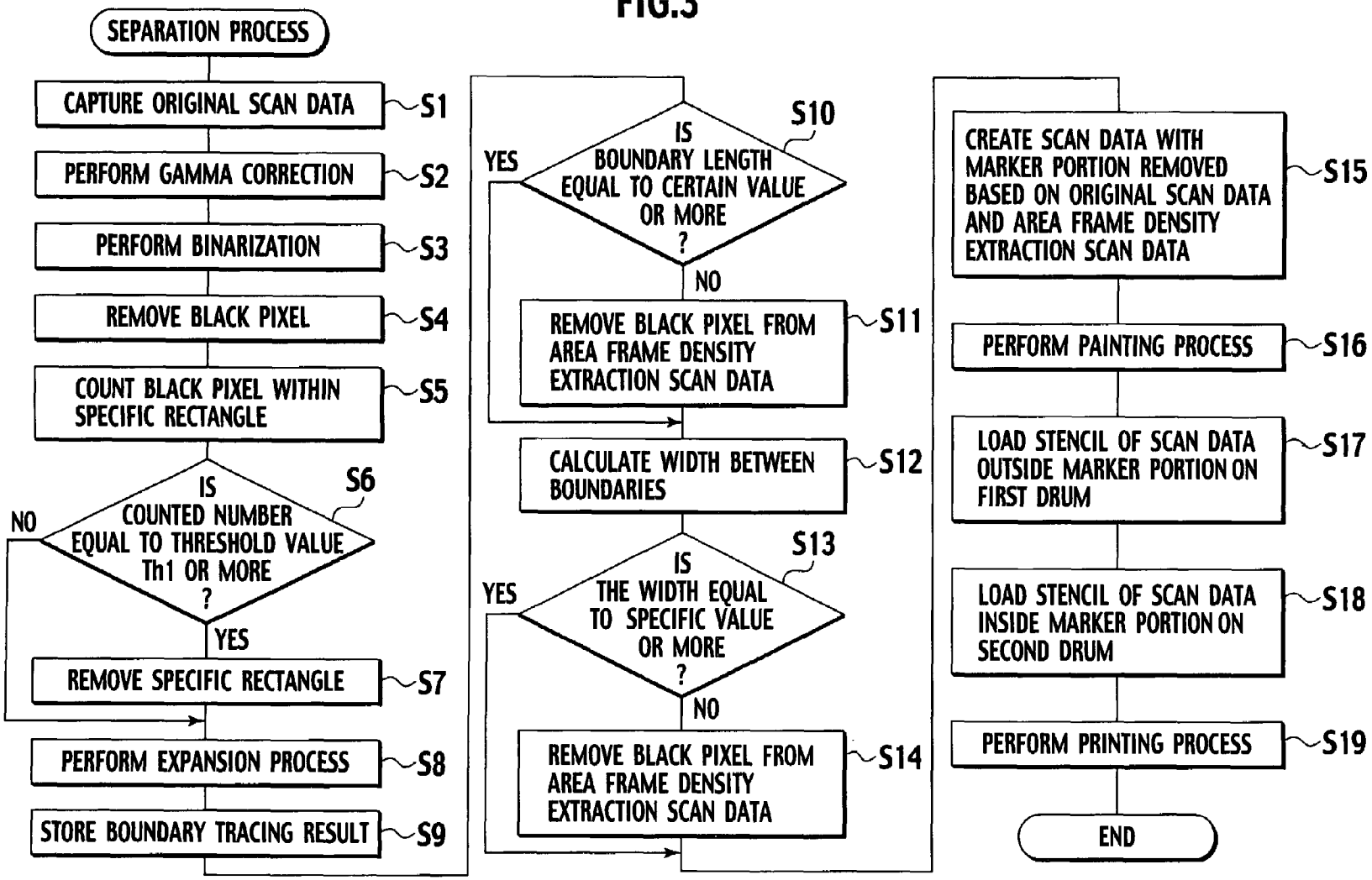
FIG. 3 is a flowchart showing a flow of a separation process as a first embodiment of the present invention.

The flowchart shown in FIG. 3 is started upon the user drawing the area frame on the original and instructing execution of the separation process through the operation panel unit 12.

Figure 4:
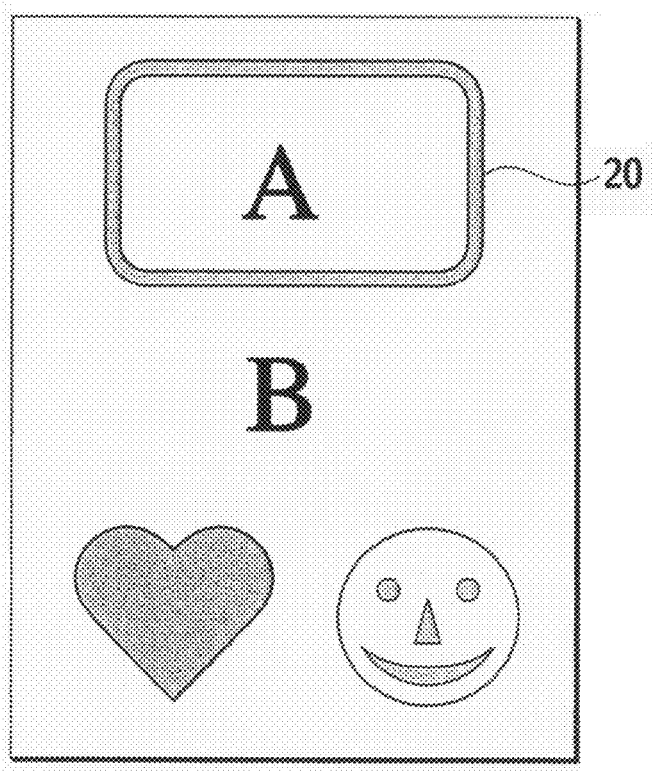
FIG. 4 is a view showing an example of original scan data.

In a process of the step S1, the controller 9 controls the original scanning unit 2 to read in image data (hereinafter, referred to as original scan data) of the set original in 8-bit form and store the read-in original scan data in the RAM 17. The original scan data is composed of a plurality of pixels arranged in a two-dimension matrix in a main scanning direction (Y) and a sub-scanning direction (X). Each pixel has a 256-tone density signal with white being 0 and black being 255. In this embodiment, as shown in FIG. 4, the original scan data contains image data of an area frame 20 specified by the user together with the image data of the original. The process of this step S1 is thus completed, and the separation process proceeds from the process of the step S1 to a process of step S2.

Figure 5:
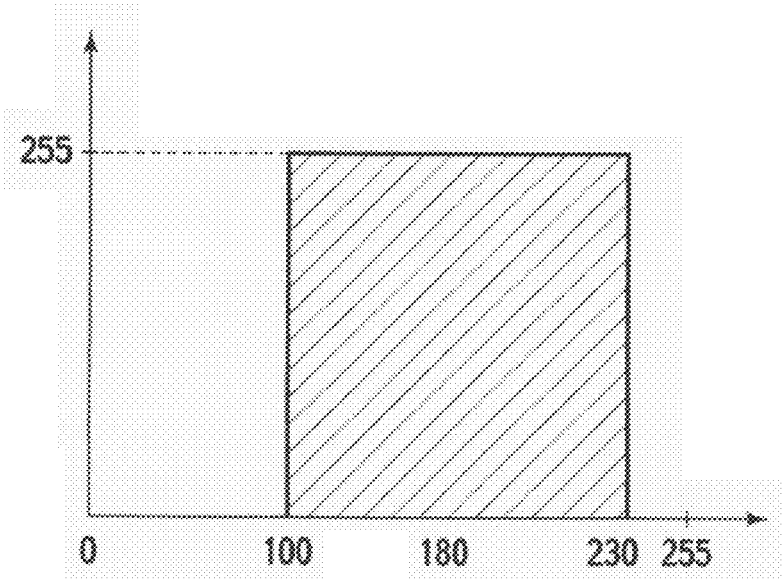
FIG. 5 is a view for explaining a method of creating scan data for area frame density extraction.

In the process of the step S2, the controller 9 reads out the original scan data from the RAM 17 and as shown in FIG. 5, performs gamma correction for the original scan data so that the density range of the marker portion (100 to 230 (tone)) is 255 (tone). This gamma correction is generally used and already publicly-known at the time of application, and the description thereof is omitted. The process of the step S2 is completed, and the separation process proceeds from the process of the step S2 to a process of the step S3.

In the process of the step S3, the controller 9 processes the original scan data so that the density range of the marker portion is 1 and the density range of the other part is 0 by binarizing the gamma-corrected original scan data using a predetermined threshold value (for example, 128). The controller 9 stores the processed original scan data in the RAM 17 as area frame density extraction scan data. In this embodiment, the controller 9 performs binarization after once storing the original scan data in the RAM 17. However, the controller 9 may first binarize the original scan data into pieces of data used in the separation process, including data for a text, data for a photograph, and the area frame density extraction data, and a boundary tracing result, and then store the same in the RAM 17. The process of the step S3 is thus completed, and the separation process proceeds from the process of the step S3 to a process of step S4.

Figure 6:
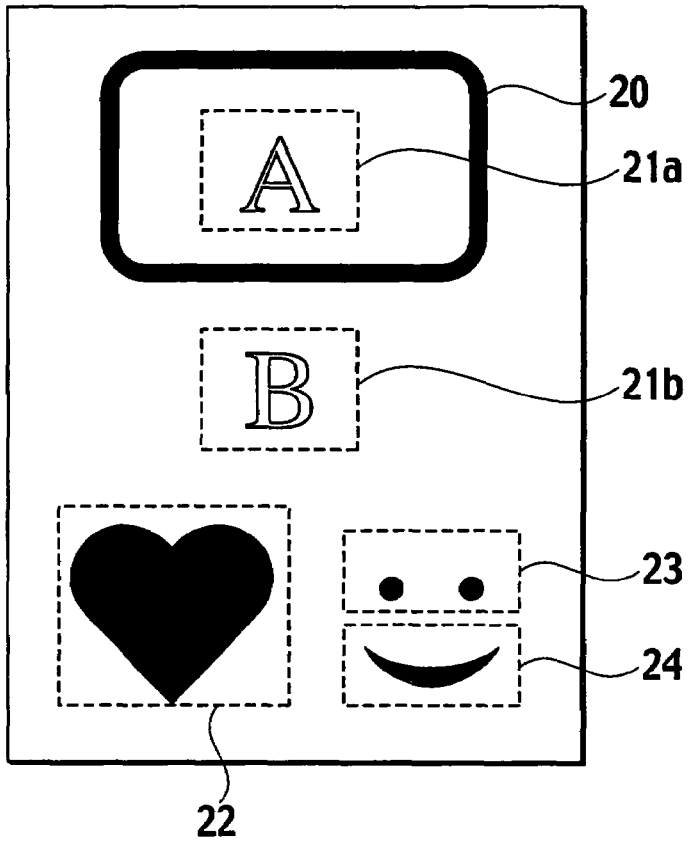
FIG. 6 is an example of the scan data for area frame density extraction.

In the case where the original scan data is one shown in FIG. 4, the area frame density extraction scan data includes, as shown in FIG. 6, image data of the area frame 20 and image data of part other than the area frame 20 (for example, letter outlines 21*a* and 21*b*, a solid area 22 having the same density as that of the area frame 20, portions 23 and 24 with white and black mixed) as noise. This is because an edge portion of an image normally changes in density from high density to low density or from low density to high density and necessarily includes an area with a same density range as that of the area frame 20. To separate the images inside and outside the area frame 20 for the first and second drums 10*a* and 10*b*, it is necessary to remove the noise and accurately recognize the area. The controller 9 therefore removes noise included in the area frame density extraction scan data in processes of the following steps S4 to S15.

Figure 7:
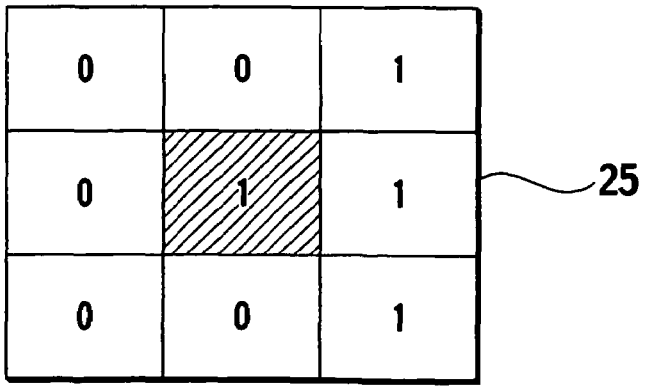
FIG. 7 is a view for explaining an example of a black pixel removal process.

In the process of the step S4, as shown in FIG. 7, the controller 9 separates the plurality of pixels constituting the frame area density extraction scan data into a plurality of rectangular areas 25 composed of 3×3 pixels and converts the pixel within each rectangular area 25 into a white pixel using pattern matching to remove black pixels corresponding to noise. Specifically, the controller 9 determines the density signals (0 or 1) of pixels within rectangular area 25, and converts all the pixels within rectangular area 25 into the white pixel according to an arrangement pattern of the density signals (example: case where at least one of the pixels within rectangular area 25 is the white pixel) to remove the black pixels, or to change the density signal from 1 to 0 (pattern matching).

The example shown in FIG. 7 has a pattern where the black pixels are located only in an area right to the target pixel (shaded portion) which is the black pixel. The controller 9 therefore determines the target pixel as noise and replaces the target pixel, which is the black pixel, into the white pixel to remove the black pixels. With such a process, the controller 9 can remove data of an image not wider than a predetermined width, including noise corresponding to the letter outlines 21*a* and 21*b* shown in FIG. 6, from the area frame density extraction scan data. The controller 9 then stores the area frame density extraction scan data having the black pixels removed in the RAM 17. The process of the step S4 is thus completed, and the separation process proceeds from the process of the step S4 to the process of the step S5.

Herein, in the process of the step S4, the controller 9 removes noise by means of pattern matching, but the present invention is not limited to this method. The controller 9 may remove noise by another method such as black pixel erosion processing using filtering. Alternatively, the controller 9 may remove noise by counting consecutive black pixels in each of the main scanning and sub-scanning directions in the area frame density extraction scan data and replacing the black pixels with the white pixels when the number of consecutive black pixels is less than a predetermined threshold value.

Figure 8:
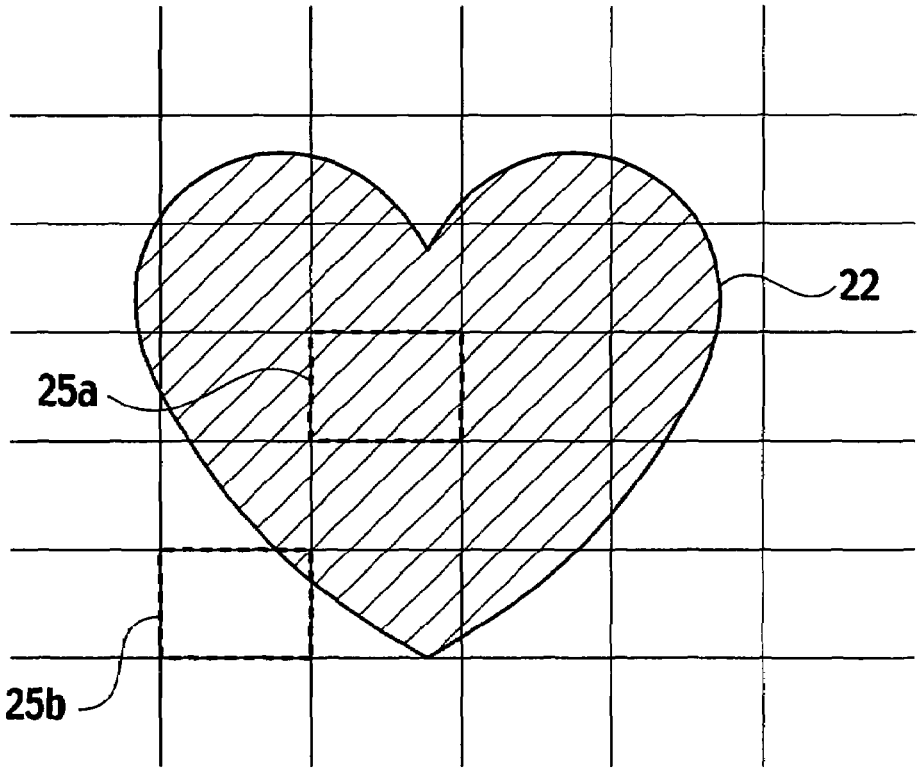
FIG. 8 is a view for explaining an example of a solid area removal process.

In the process of the step S5, as shown in FIG. 8, the controller 9 separates the area frame density extraction scan data processed in the step S4 into a plurality of specific rectangular areas and counts the number of black pixels included in each specific rectangular area. Herein, FIG. 8 shows an area around the solid area 22 at the bottom left of FIG. 6 partially enlarged. The process of the step S5 is thus completed, and the separation process proceeds from the process of the step S5 to the process of the step S6.

In the process of the step S6, the controller 9 determines whether the number of black pixels included in each specific rectangular area is less than a threshold value Th1. As a result of the determination, when the number of black pixels included in the specific rectangular area is not less than the threshold value Th1, for example, like a specific rectangular area 25*a* shown in FIG. 8, the controller 9 determines this specific rectangular area to be solid part other than the area frame and advances the separation process to the process of the step S7.

On the other hand, like a specific rectangular area 25*b* shown in FIG. 8, when the number of black pixels included in the specific rectangular area is less than the threshold value Th1, the controller 9 determines this specific rectangular area to be not solid part and then advances the separation process to the process of the step S8. The size of each specific rectangular area and the threshold value Th1 are determined according to width of the marker used by the user to specify the area frame 20 or a method of specifying the area frame 20.

In the process of the step S7, the controller 9 removes the specific rectangular areas including black pixels not less than the threshold value Th1 from the area frame density extraction scan data. According to such a process, the controller 9 can remove noise corresponding to the solid area 22 with a density same as that of the area frame 20 shown in FIG. 6 from the area frame density extraction scan data. The controller 9 then stores the area frame density extraction scan data with solid areas removed in the RAM 17. The process of the step S7 is thus completed, and the separation process proceeds from the process of the step S7 to the process of the step S8.

In the process of the step S8, the controller 9 performs an expansion process for the area frame density extraction scan data processed in the step S7 to enlarge a black pixel area by a several pixels. This expansion process is to prevent the later described boundary tracing process and removal process for the area frame 20 from being incorrectly performed because the area frame 20 is partially lost by the noise removal process of the steps S4 and S7. The expansion process is performed by converting a predetermined width of white pixels adjacent to each black pixel into the black pixels, for example, by means of white pixel erosion processing using filtering or the like. The controller 9 then stores the area frame density extraction scan data after the expansion process in the RAM 17. The process of the step S8 is thus completed, and the separation process proceeds from the process of the step S8 to the process of the step S9.

Figure 9:
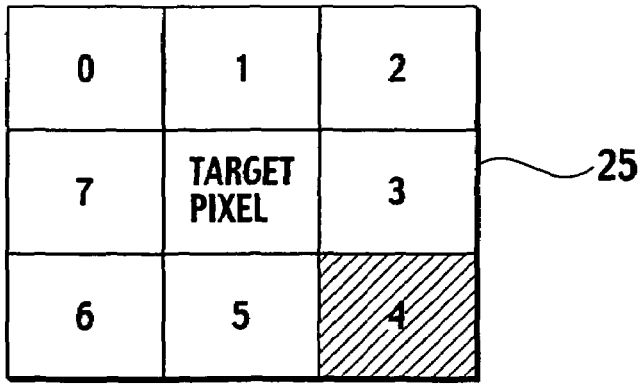
FIG. 9 is a view for explaining an example of a boundary tracing process.

In the process of the step S9, the controller 9 performs the boundary tracing process for an image included in the area frame extraction scan data after the expansion process. Specifically, as shown in FIG. 9, the controller 9 separates the area frame density extraction scan data into the plurality of rectangular areas 25 each composed of 3×3 pixels and searches for the black pixel adjacent to the target pixel according to a predetermined search order (0 to 7). The controller 9 may also perform the boundary tracing process for an image area within a boundary. When the controller 9 extracts the black pixel adjacent to the target pixel, the controller 9 repeats the same process using the extracted black pixel as the next target pixel to extract a boundary and then stores the result of boundary tracing in the RAM 17. The process of the step S9 is thus completed, and the separation process proceeds from the process of the step S9 to the process of the step S10.

In the process of the step S10, the controller 9 determines with reference to the result of boundary tracing whether the length of each boundary is less than a certain value. As a result of the determination, the controller 9 determines that a boundary with a length not less than the certain value is the boundary of the area frame 20 and then advances the separation process to the process of the step S12.

On the other hand, the controller 9 determines that a boundary with a length less than the certain value is not the boundary of the area frame 20. The controller 9 then removes the black pixels corresponding to the boundary of interest and the inside of the boundary from the area frame density extraction scan data as the process of the step S11 and advances the separation process to the process of the step S12. With such a process, the controller 9 can remove noise corresponding to the portion 23 shown in FIG. 6 where the white pixels and the black pixels are subtly mixed, such as a vicinity of the outline of a human face, from the area frame density extraction scan data.

Herein, when the boundary length exceeds a range normally possible, for example, a length exceeding the outer peripheral length of the original, the controller 9 may determine that the boundary of interest is not the boundary of the area frame 20. It is therefore possible to properly remove noise caused by a marking error or an original scanning error.

Figure 10:
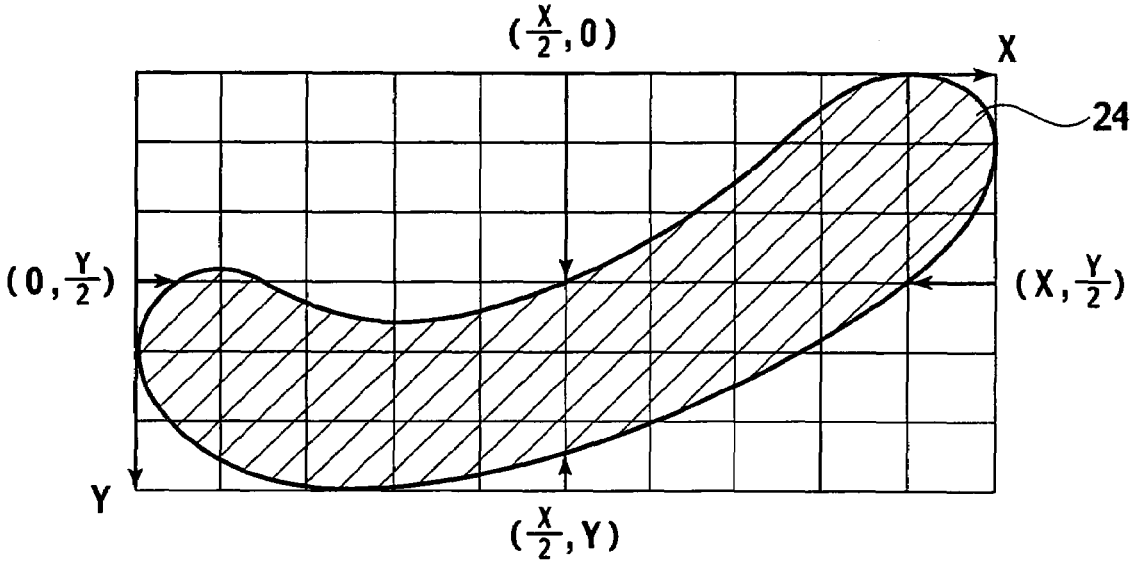
FIG. 10 is a view for explaining a method of calculating boundary inside width.

In the process of the step S12, the controller 9 calculates boundary inside widths in the main scanning and sub-scanning directions for each boundary stored in the process of the step S11. Specifically, as shown in FIG. 10, after defining a circumscribed quadrangle (X, Y) of an image, the controller 9 scans the image in the direction Y from a specific position 1 (X/2, 0) to a specific position 2 (X/2, Y) in the circumscribed quadrangle and calculates the distance between a position where the boundary is detected first and a position where the boundary is detected next as the boundary inside width in the sub-scanning direction. In a similar manner, the controller 9 scans in the direction X from a specific position 3 (0, Y/2) to a specific position 4 (X, Y/2) in the circumscribed quadrangle and calculates the distance between a position where the boundary is detected first and a position where the boundary is detected next as the boundary inside width in the main scanning direction. The process of the step S12 is thus completed, and the separation process proceeds from the process of the step S12 to the process of the step S13.

In the process of the step S13, the controller 9 determines whether the calculated boundary inside widths in the main scanning and sub-scanning directions are equal to or more than a specific value. As a result of the determination, the controller 9 determines that a boundary of which the calculated boundary inside widths are not less than the specific value is the boundary of the area frame 20 and then advances the separation process to the process of the step S15.

Figure 14:
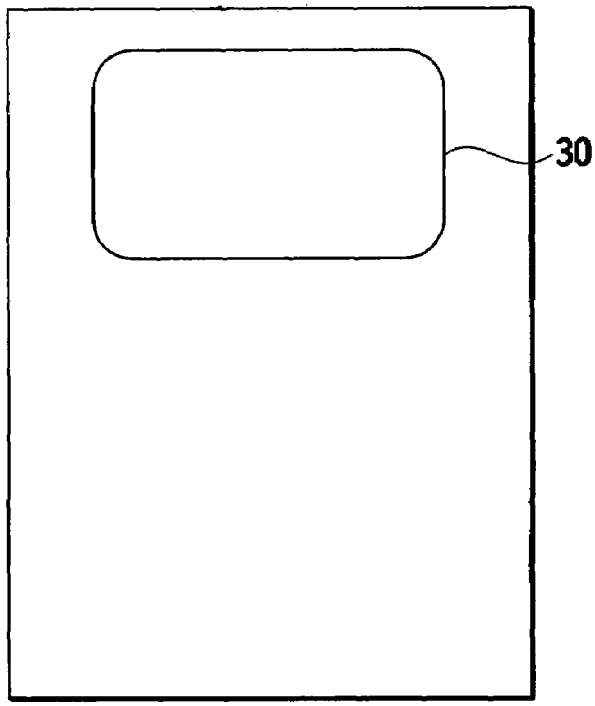
FIG. 14 is a view showing an example of a boundary tracing result.

On the other hand, the controller 9 determines that a boundary in which at least any one of the calculated boundary inside widths is less than the specific value is not the boundary of the area frame 20. In the process of the step S14, the controller 9 removes the black pixels corresponding to the boundary of interest and the inside of the boundary from the area frame density extraction scan data and then advances the separation process to the process of the step S15. With such a process, the controller 9 can remove noise corresponding to an image whose length of the boundary is short and an image whose length of the boundary is long but which is narrow and store data of a boundary 30 at the outer periphery of the area frame 20 as shown in FIG. 14 in the RAM 17 as the boundary tracing result.

In the process of the step S15, the controller 9 deletes scan data of the area frame 20 (marker portion) stored as the area frame density extraction scan data from the original scan data to create scan data with the area frame 20 (marker portion) removed. The process of the step S15 is thus completed, and the separation process proceeds from the process of the step S15 to the process of the step S16.

In the process of the step S16, the controller 9 processes the area frame density extraction scan data so that all pixels within the area frame 20 are converted into the black pixels, thus creating paint data. The process of the step S16 is thus completed, and the separation process proceeds from the process of the step S16 to the process of the step S17.

Figure 11:
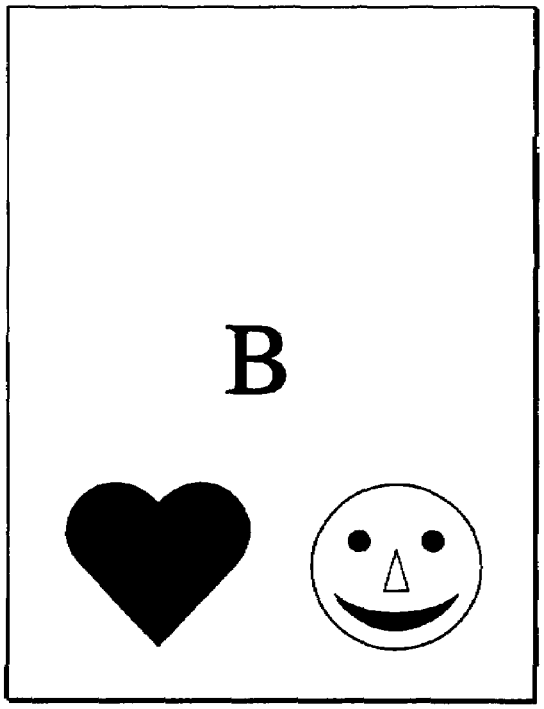
FIG. 11 is a view showing an example of image data outside the area frame.

In the process of the step S17, the controller 9 extracts image data outside the area frame 20 as shown in FIG. 11 using the original scan data and the paint data. The controller 9 then controls the stencil making unit 3 so that a stencil is perforated by heat according to the extracted image data and controls the printing unit 4 so that the master perforated by heat according to the image data outside the area frame 20 is loaded on the first drum 10*a*. The process of the step S17 is thus completed, and the separation process proceeds from the process of the step S17 to the process of the step S18.

Figure 12:
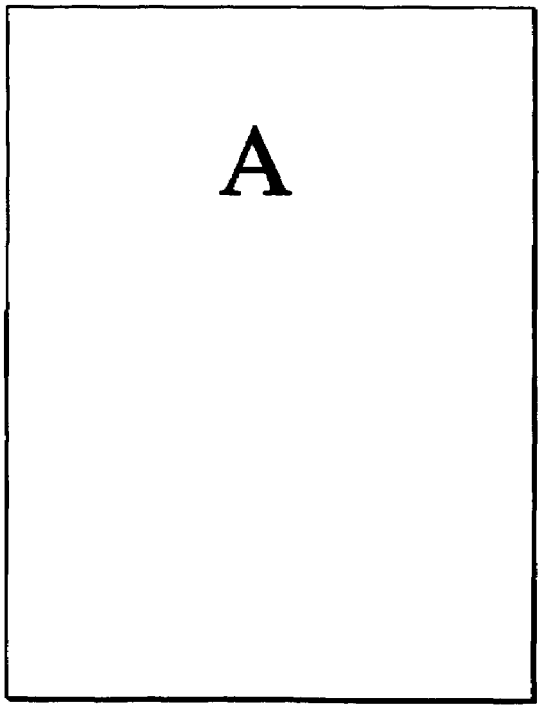
FIG. 12 is a view showing an example of image data inside the area frame.

In the process of the step S18, the controller 9 extracts image data inside the area frame 20 as shown in FIG. 12 using the original scan data and the paint data. The controller 9 then controls the stencil making unit 3 so that a stencil is perforated by heat according to the extracted image data and controls the printing unit 4 so that the master perforated by heat according to the image data inside the area frame 20 is loaded on the second drum 10*b*. The process of the step S18 is thus completed, and the separation process proceeds from the process of the step S18 to the process of the step S19.

In the process of the step S19, the controller 9 controls each component within the stencil printing machine 1 to start printing while the masters perforated by heat according to the image data outside and inside the area frame 20 are loaded on the first and second drums 10*a* and 10*b*. The process of the step S19 is thus completed, and a series of steps of the separation process are terminated.

As apparent from the above description, in the separation process as the first embodiment of the present invention, according to the separation program 13, the controller 9 reads out the image data of the area frame 20 which the user has drawn on the original, removes noise from the read-out image data to accurately extract the area frame 20, and separates the image data of the areas inside and outside the area frame 20. With such a configuration, the controller 9 performs the separation process by means of the software processing and can perform the separation process with an existing hardware configuration. The user can execute the separation process only by drawing the area frame 20 on the original and instructing the execution of the separation process. Accordingly, the user can perform the separation process with easy operations which do not feel troublesome. Furthermore, the user does not need to cause the machine to scan another sheet for specifying a separation area, thus preventing the increase of the man-hours required for the separation process. In other words, according to the separation process as the first embodiment of the present invention, it is possible to separate the images inside and outside the area frame 20 without increasing the costs and man-hours with easy operations not making the user feel troublesome.

In the separation process as the first embodiment, the sheet for specifying the separation area is not used, but the area frame 20 may be specified by causing the stencil printing machine 1 to scan a white sheet on which the area frame 20 is specified. According to such a method, the noise removal process and the process to remove the area frame 20 from the original scan data can be omitted, and the separation process can be performed at higher speed accordingly. However, when the above sheet is not a white sheet but a sheet from which the noise could be detected by scanning, like a scratch paper, it is desirable to perform the aforementioned noise removal process as a third separation printing mode. When the user specifies the area frame 20 on the back of the original, the area frame 20 can be accurately recognized by horizontally flipping the image data and performing the noise removal process for the horizontally flipped data.

Figure 13:
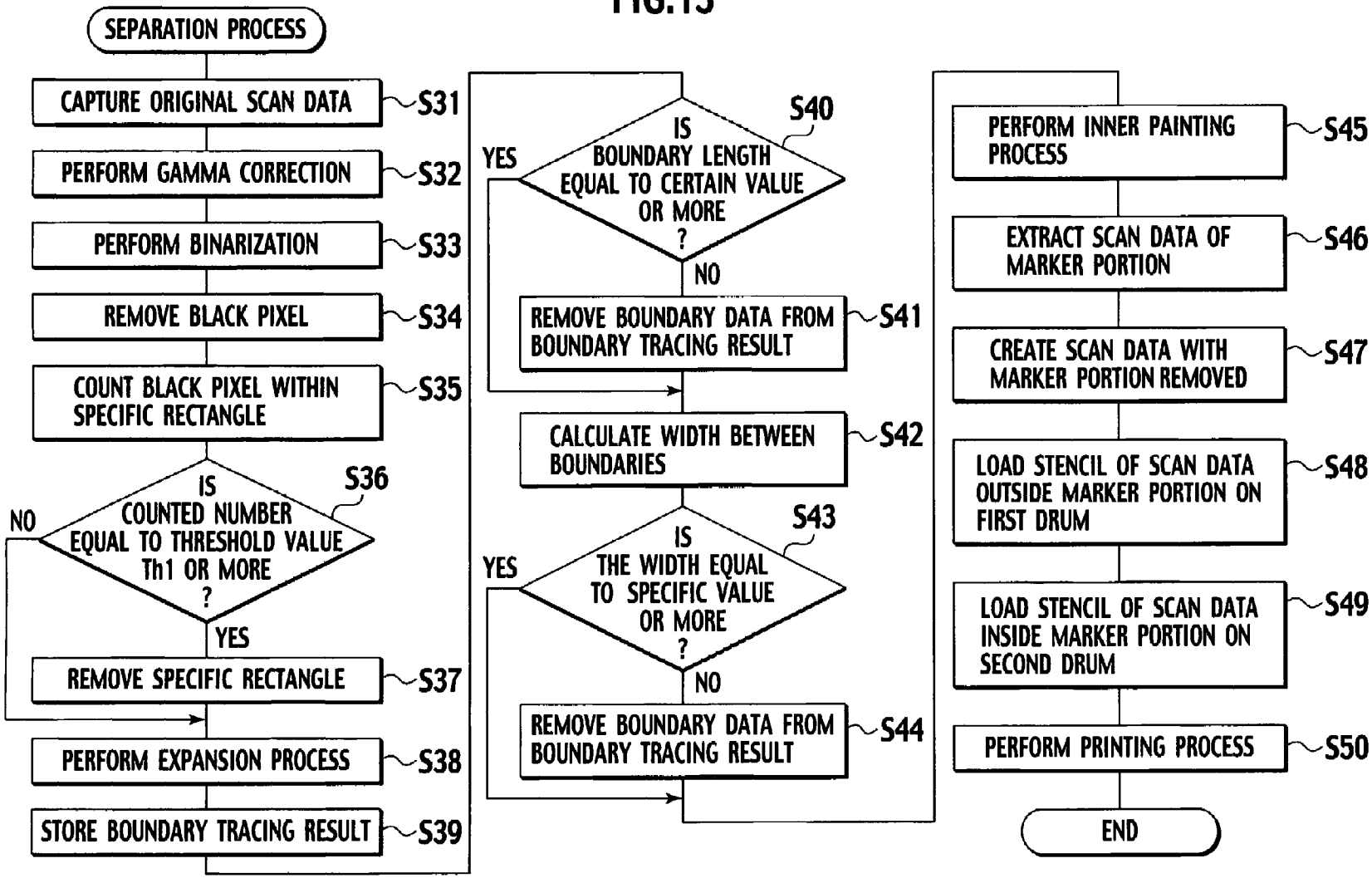
FIG. 13 is a flowchart showing an application example of the separation process as the first embodiment of the present invention.

In the separation process as the first embodiment, the black pixels corresponding to the boundary whose length is less than the certain value and the boundary whose boundary inside width is less than the specific value are removed from the area frame density extraction scan data to create the scan data with the area frame 20 removed using this area frame density extraction scan data and the original scan data. However, it is possible to create the scan data with the area frame 20 removed by removing data of the boundary whose length is less than the certain value and the boundary whose boundary inside width is less than the specific value from the boundary tracing result and using this boundary tracing result and the area frame density extraction scan data after the expansion process. Hereinafter, a description is given of an action of the controller 9 in this case with reference to a flowchart shown in FIG. 13. Processes of steps S31 to S39 shown in FIG. 13 are the same as those of the steps S1 to S9 shown in FIG. 3, and the following description is given of only processes of step S40 and subsequent steps.

In the process of the step S40, the controller 9 determines for each boundary with reference to the boundary tracing result whether the boundary length is less than the certain length. As a result of the determination, the controller 9 determines that a boundary with a length not less than the certain value is the boundary of the area frame 20 and then advances the separation process to the process of the step S42. On the other hand, the controller 9 determines that a boundary with length less than the certain value is not the boundary of the area frame 20 and removes data of the boundary of interest from the boundary tracing result as the process of the step S41. The controller 9 then advances the separation process to the process of the step S42.

In the process of the step S42, for each boundary, the controller 9 calculates the boundary inside widths in the main scanning and sub-scanning directions. The process of the step S42 is thus completed, and the separation process proceeds from the process of the step S42 to the process of the step S43.

In the process of the step S43, the controller 9 determines for each boundary whether the calculated boundary inside widths in the main-scanning and sub-scanning directions are less than the specific value. As a result of the determination, the controller 9 determines that a boundary in which the calculated boundary inside widths are not less than the specific value is the boundary of the area frame 20 and then advances the separation process to the step S45. On the other hand, the controller 9 determines that a boundary in which at least any one of the calculated boundary inside widths is less than the specific value is not the boundary of the area frame 20 and then removes data of the boundary of interest from the boundary tracing result as the process of the step S44. The controller 9 then advances the separation process to the process of the step S45.

In the process of the step S45, the controller 9 recognizes the location of the boundary 30 (see FIG. 14) at the outer periphery of the area frame 20 with reference to the boundary tracing result stored in the RAM 17 and processes the data of the boundary so that all the pixels within the boundary 30 are converted into the black pixels, thus creating boundary inside paint data. The controller 9 then creates area frame inside paint data in which the inside of the area frame 20 is painted out, which corresponds to an area 31 shown in FIG. 15, using the boundary inside paint data and the area frame density extraction scan data after the expansion process. The process of the step S45 is thus completed, and the separation process proceeds from the process of the step S45 to the process of the step S46.

Figure 15:
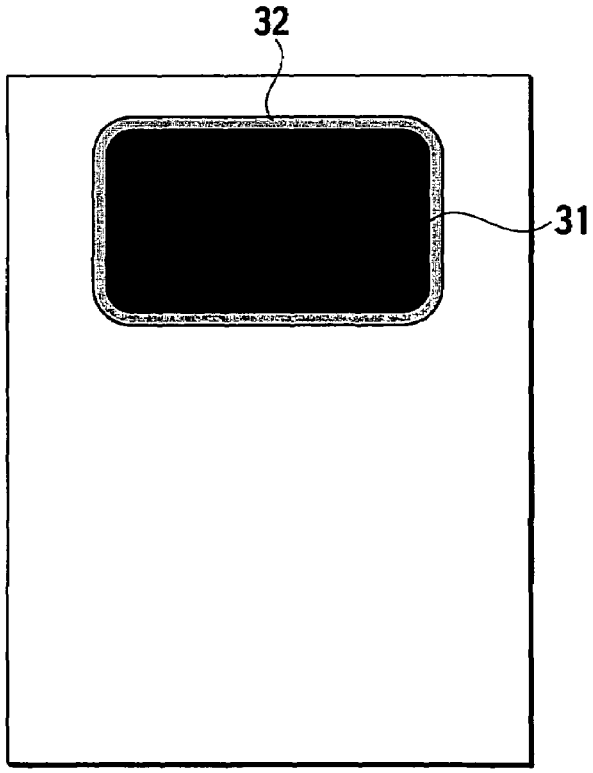
FIG. 15 is a view showing boundary inside paint data and area frame inside paint data.

In the process of the step S46, the controller 9 creates scan data of the area frame 20 (marker portion), which corresponds to an area 32 shown in FIG. 15, using the boundary inside paint data and area frame inside paint data. The process of the step S46 is thus completed, and the separation process proceeds from the process of the step S46 to the process of the step S47.

In the process of the step 947, the controller 9 deletes the scan data of the area frame 20 (marker portion) stored as the area frame density extraction scan data from the original scan data to create scan data with the area frame 20 (marker portion) removed. The process of the step S47 is thus completed, and the separation process proceeds from the process of the step S47 to the step S48.

In the process of the step S48, the controller 9 extracts the image data outside the area frame 20 using the scan data with the area frame 20 (marker portion) removed and the boundary inside paint data. The controller 9 then controls the stencil making unit 3 so that a stencil is perforated by heat according to the extracted image data and controls the printing unit 4 so that the master perforated by heat according to the image data outside the area frame 20 is loaded on the first drum 10*a*. The process of the step S48 is thus completed, and the separation process proceeds from the process of the step S48 to the process of the step S49.

In the process of the step S49, the controller 9 extracts the image data inside the area frame 20 using the scan data with the area frame 20 removed and the area frame inside paint data. The controller 9 then controls the stencil making unit 3 so that a stencil is perforated by heat according to the extracted image data and controls the printing unit 4 so that the master perforated by heat according to the image data inside the area frame 20 is loaded on the second drum 10*b*. The process of the step S49, is thus completed, and the separation process proceeds from the process of the step S49 to the process of the step S50.

In the process of the step S50, the controller 9 controls each component within the stencil printing machine 1 to start printing while the masters having been perforated by heat according to the image data outside and inside the area frame 20 are loaded on the first and second drums 10*a* and 10*b*, respectively. The process of the step S50 is thus completed, and a series of steps of the separation process are terminated.

Figure 16:
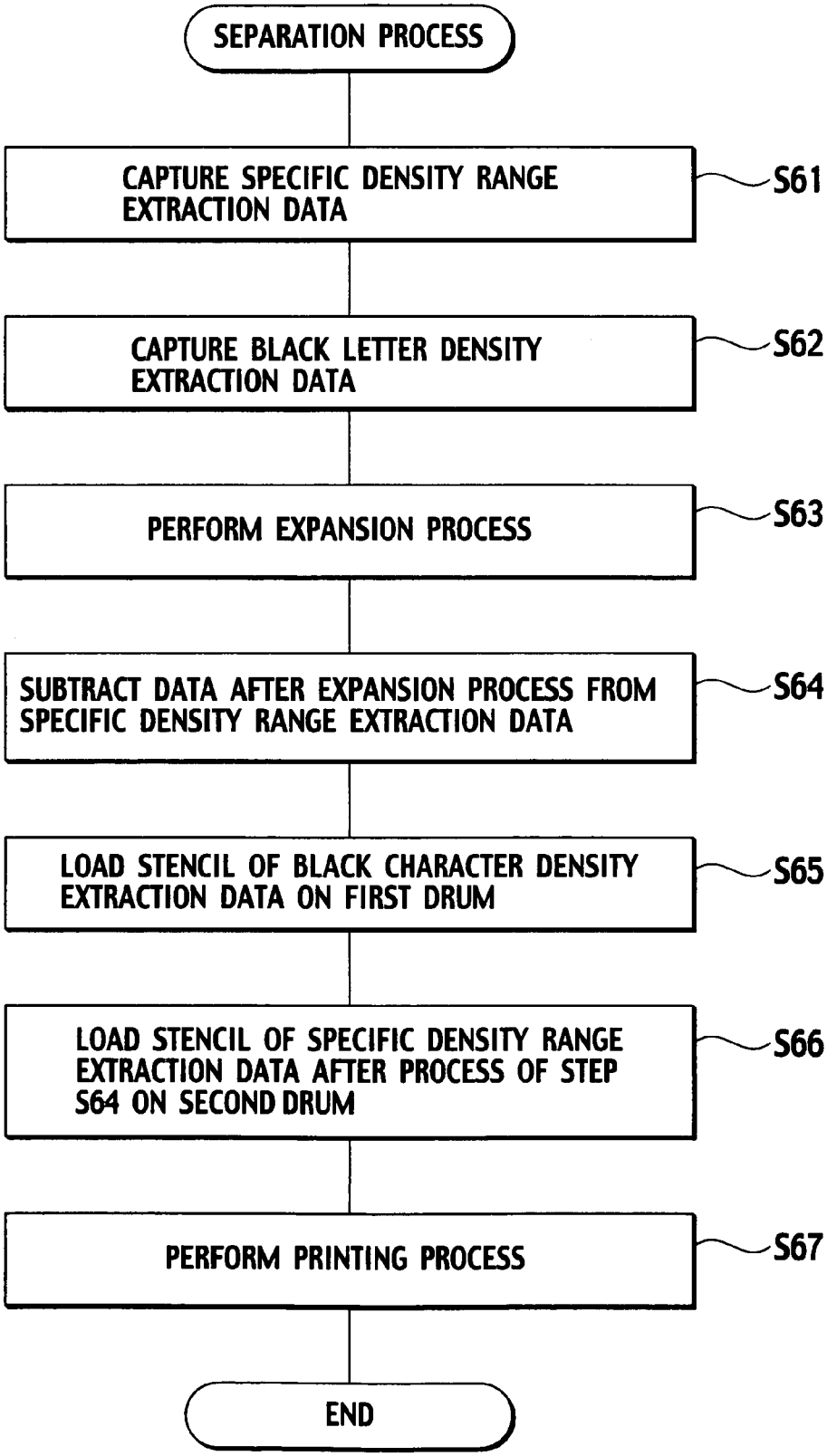
FIG. 16 is a flowchart showing a flow of a separation process as a second embodiment of the present invention.

Next, a description is given of an action of the stencil printing machine 1 executing a separation process as the second embodiment of the present invention with reference to a flowchart shown in FIG. 16. The separation process as the second embodiment is a process to separate black letters and an image with a specific density range within an original, such as separation of black letters and colored letters, and the following description is given of a process in the case of separating red letters from black letters.

The flowchart shown in FIG. 16 starts when the user instructs execution of the separation process as the second embodiment through the operation panel unit 12 and the controller 9 controls the original scanning unit 2 to read in image data (original scan data) of the set original.

In a process of step S61, the controller 9 performs gamma correction for the original scan data so that the specific density range (density range of red letters in this example) is 255 (tone) and processes the original scan data gamma-corrected so that the specific density range of the marker is 1 by binarizing the gamma-corrected original scan data using a predetermined threshold value. The controller 9 stores the processed original scan data in the RAM 17 as scan data (hereinafter, abbreviated to the specific density range extraction data) for specific density range extraction. The process of the step S61 is thus completed, and the separation process proceeds from the process of the step S61 to the process of the step S62.

Figure 17:
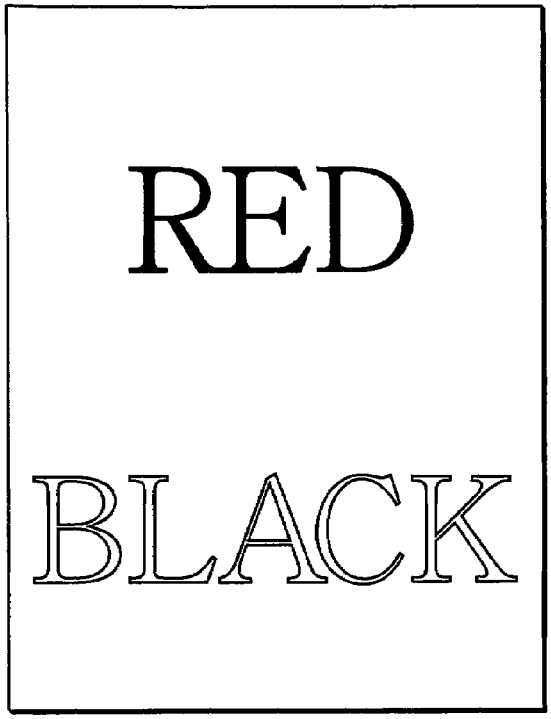
FIG. 17 is a view showing an example of specific density range extraction data.

The outline portion of a black letter changes in density from the density of the base of the original to the density of the black letter and necessarily includes the specific density range. As shown in FIG. 17, the specific density range extraction data created by the process of the step S61 includes the outline portions of black letters as noise together with the image data of red letters. The controller 9 removes noise included in the specific density range extraction data by processes of the following steps S63 and S64.

Figure 18:
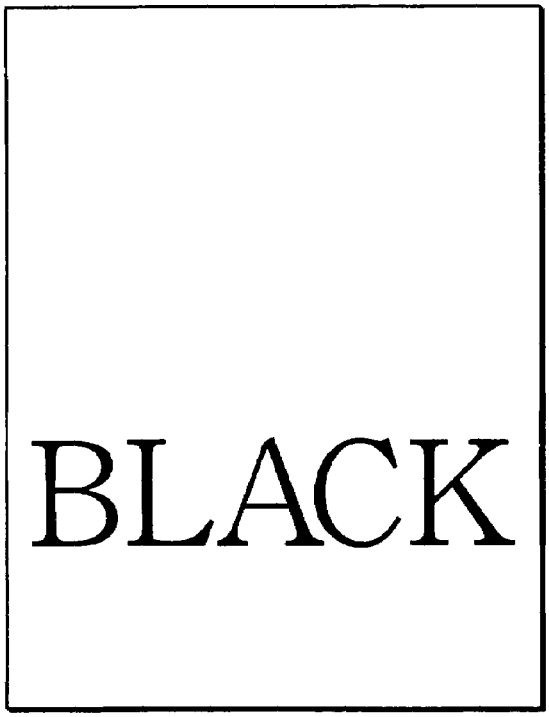
FIG. 18 is a view showing an example of black letter density extraction data.
Figure 19:
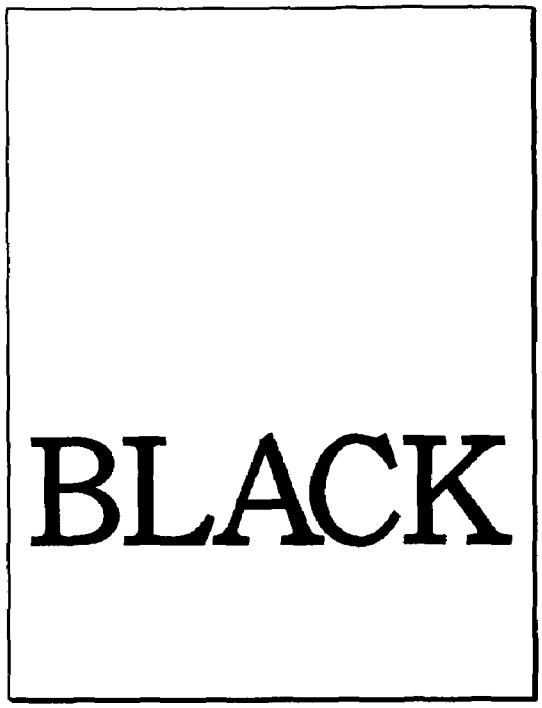
FIG. 19 is a view showing an example of the black letter density extraction data after an expansion process.

In the process of step S62, the controller 9 performs gamma correction for the original scan data so that the density range of the black letters is 255 (tone) and then processes the original scan data gamma-corrected so that the density range of the black letters is 1 by binarizing the gamma-corrected original scan data using a predetermined threshold value. The controller 9 stores the processed original scan data in the RAM 17 as scan data (hereinafter, abbreviated to the black letter density extraction data) for black letters density extraction as shown in FIG. 18. The process of the step S62 is thus completed, and the separation process proceeds from the process of the step S62 to the process of the step S63.

In the process of the step S63, the controller 9 performs the expansion process for the black letter density extraction data by changing a pixel which is adjacent to the black letters from the white pixel into the black pixel. The expansion process is the same as that of in the separation process as the first embodiment, and the explanation thereof is omitted. The process of the step S63 is thus completed, and the separation process proceeds from the process of the step S63 to the process of the step S64.

Figure 20:
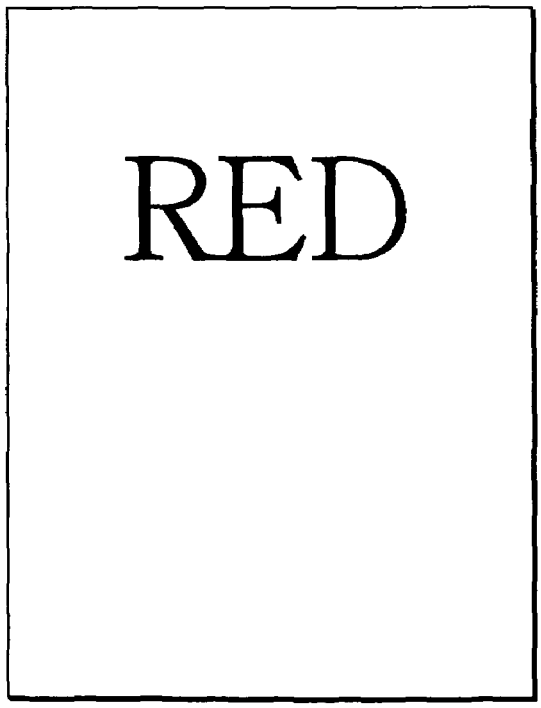
FIG. 20 is a view showing an example of the specific density range extraction data after a noise removal process.

In the process of the step S64, the controller 9 subtracts the black letter density extraction data after the expansion process from the specific density range extraction data to remove noise included in the specific density range extraction data as shown in FIG. 20. The process of the step S64 is thus completed, and the separation process proceeds from the process of the step S64 to a process of step S65.

In the process of the step S65, the controller 9 controls the stencil making unit 3 so that a stencil is perforated by heat according to the black letter density extraction data and then controls the printing unit 4 so that the master perforated by heat according to the black letter density extraction data is loaded on the first drum 10*a*. The process of the step S65 is thus completed, and the separation process proceeds from the step S65 to a process of step S66.

In the process of the step S66, the controller 9 controls the stencil making unit 3 so that a stencil is perforated by heat according to the specific density range extraction data with noise removed and then controls the printing unit 4 so that the stencil perforated by heat according to the specific density range extraction data is loaded on the second drum 10*b*. The process of the step S66 is thus completed, and the separation process proceeds from the step S66 to a process of step S67.

Figure 21:
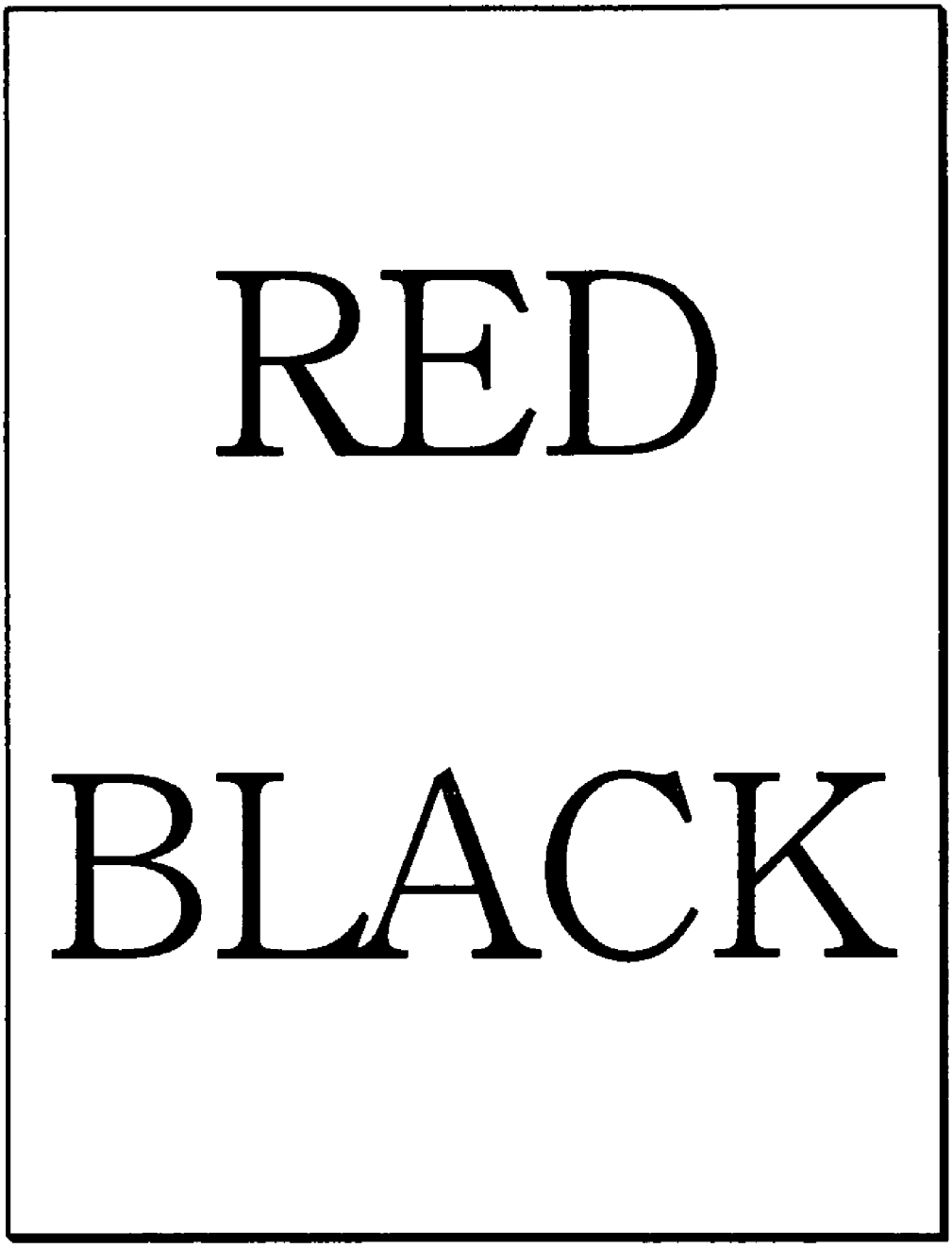
FIG. 21 is a view showing an example of a print result obtained by the separation process shown in FIG. 16.

In the process of the step S67, the controller 9 controls each component within the stencil printing machine 1 to start printing while the stencils are perforated by heat according to the black letter density extraction data and the specific density range extraction data are loaded on the first and second drums 10*a* and 10*b*, respectively. The process of the step S67 is thus completed, and the print sheets P on which an image shown in FIG. 21 are printed are discharged, thus terminating a series of steps of the separation process.

As apparent from the above description, with the separation process as the second embodiment of the present invention, according to the separation program 13, the controller 9 reads out the image data of the specific density range, removes noise from the read-out image data to accurately extract the image data of the specific density range, and separates the image data of the specific density range and the image data of the black letters. With such a configuration, the controller 9 performs the separation process by means of the software processing and can perform the separation process with an existing hardware configuration. The user can execute the separation process only by instructing the execution of the separation process. Accordingly, the user can perform the separation process with easy operations which does not feel troublesome. Furthermore, the user does not need to cause a machine to scan the sheet for specifying a separation area, thus preventing the increase of the man-hours required for the separation process and preventing the addition of noise difficult to remove to the original image when the sheet is contaminated. In other words, according to the separation process as the second embodiment of the present invention, it is possible to separates the images of the black letters and the specific density range within the original without increasing the costs and man-hours with easy operations not making the user feel troublesome. This separation process is effective for the case where the original is test paper in which answers are written with red letters.

Hereinabove, the description is given of the embodiments to which the present invention made by the inventor is applied, but the present invention is not limited by the description and the drawings constituting part of the disclosure of the present invention by the embodiments. For example, the controller 9 may be configured to be capable of executing the separation processes as both the first and second embodiments and allow the user to select and execute through the operation panel unit 12 one of the separation processes of the first and second embodiments. With such a configuration, it is possible to provide a stencil printing machine capable of selectively executing various separation processes that the user desires and to provide a method of controlling the same. This can improve convenience for the user as follows. The separation process as the first embodiment is selected when the user wants to directly specify an area with a marker on the original, and the separation process as the second embodiment is selected for an original created with two colors. Finally, as described above, it is obvious that other embodiments, examples, operational technologies, and the like made by skilled in the art based on the aforementioned embodiments are within the scope of the present invention.

The entire content of Japanese Patent Application No. TOKUGAN 2004-126474 with a filing date of Apr. 22, 2004, is hereby incorporated by reference.

The invention claimed is:

1. A stencil printing machine including a plurality of drum units, comprising:

an original scanning unit reading in image data of an original as original image data, the original including a black letter and an image with a specific density range; and a controller including: a unit for reading out image data of the black letter and image data of the image with the specific density range from the original image data as black letter extraction data and specific density range extraction data, respectively; and a unit for removing noise from the specific density range extraction data, the controller controlling the stencil printing machine to divide an image of the black letter and the image with the specific density range into separate stencils using the specific density range extraction data with noise removed and the black letter extraction data.

2. The stencil printing machine according to claim 1, wherein the unit for removing noise comprises:

a unit for expanding black pixels in the black letter extraction data by a predetermined width of pixels; and a unit for subtracting the black letter extraction data after an expansion process from the specific density range extraction data.

3. A method of controlling a stencil printing machine including a plurality of drum units, comprising the steps of:

reading in image data of an original as original image data, the original including a black letter and an image with a specific density range;

reading out image data of the black letter and image data with a specific density range from the original image data as black letter extraction data and specific density range extraction data, respectively;

removing noise from the specific density range extraction data; and controlling the stencil printing machine to divide an image of the black letter and the image with the specific density range into separate stencils using the specific density range extraction data with noise removed and the black letter extraction data.

* * * * *